US006213350B1

(12) United States Patent
Polykandriotis

(10) Patent No.: US 6,213,350 B1
(45) Date of Patent: Apr. 10, 2001

(54) CLOSURE HAVING TUBE APERTURE

(76) Inventor: Anthony Polykandriotis, 8 Green Street, Revesby, New South Wales, 2212 (AU)

( * ) Notice: Subject to any disclaimer, the term of this patent is extended or adjusted under 35 U.S.C. 154(b) by 0 days.

(21) Appl. No.: 09/155,414

(22) PCT Filed: Mar. 26, 1997

(86) PCT No.: PCT/AU97/00201

§ 371 Date: Feb. 22, 2000

§ 102(e) Date: Feb. 22, 2000

(87) PCT Pub. No.: WO97/35776

PCT Pub. Date: Oct. 2, 1997

(30) Foreign Application Priority Data

Mar. 26, 1996 (AU) ..... PN8948

(51) Int. Cl.[7] ..... B67B 5/00

(52) U.S. Cl. ..... 222/153.06; 222/153.02; 222/538

(58) Field of Search ..... 222/529, 531, 222/541.5, 153.02, 153.06, 211, 530, 538

(56) References Cited

U.S. PATENT DOCUMENTS

| | | | | |
|---|---|---|---|---|
| 3,496,746 | | 2/1970 | Laurizio . | |
| 4,019,663 | * | 4/1977 | Krautkramer | 222/529 |
| 4,022,357 | * | 5/1977 | Dwinell | 222/538 |
| 4,461,406 | * | 7/1984 | Vannucci | 222/530 |
| 4,650,096 | | 3/1987 | Thatcher . | |
| 4,726,491 | | 2/1988 | Moon . | |
| 5,388,712 | * | 2/1995 | Brody | 222/530 |
| 5,456,374 | * | 10/1995 | Beck | 222/548 |

FOREIGN PATENT DOCUMENTS

| | | |
|---|---|---|
| 37273/58 | 10/1959 | (AU) . |
| 23812/88 | 9/1988 | (AU) . |
| 70211/91 | 2/1991 | (AU) . |
| 20911/92 | 8/1992 | (AU) . |
| 50605/96 | 4/1996 | (AU) . |
| 583576 | 6/1993 | (EP) . |

OTHER PUBLICATIONS

Bayliss, Improvements in or relating to Pouring Devices for Containers, English Provisional Application, May 1961.*

* cited by examiner

*Primary Examiner*—Kevin Shaver
*Assistant Examiner*—David A. Bonderer
(74) *Attorney, Agent, or Firm*—Thorpe, North & Western

(57) ABSTRACT

A closure (10) that can be used to seal containers for various vehicle oils is described. The closure (10) has a main portion adapted to seal with the neck of the top (11) of the main closure. The cup (30) is connected to the top portion (11) of this main closure through a number of frangible bridges (34) such that any removal of the cap (30) from the main portion of the closure can be readily determined by a potential purchaser or user of the contents of the container (15).

13 Claims, 3 Drawing Sheets

CLOSURE HAVING TUBE APERTURE

FIELD OF THE INVENTION

The present invention relates to closures and in particular to a closure for use in sealing containers for fluids.

BACKGROUND OF THE INVENTION

Like the manufacturers of foodstuffs and beverages, the manufacturers of motor vehicle oils, such as engine and transmission oil, have become concerned to ensure that the product sold to consumers has not suffered tamper prior to its use by the consumer. To provide a greater indication of attempted or successful tamper, tamper evident bands that at least partially fracture from the closure on removal of the closure from the container have been used.

Because of the increase in recent years of self-service petrol stations and the sale of vehicle products, including oil, from convenience and department stores, it has now become common for the general public to both check their vehicle's various oil levels and top up the level as required. In order to ensure a minimum of fuss and mess, oil is now sometimes sold in containers in which instead of having to remove the closure, a tube is pre-positioned through an aperture in the top of the closure. The tube can be extended by the consumer without removing the closure to allow more precise pouring of the oil where required and so lessen the likelihood of mess.

While the provision of a tube through an aperture in the closure has a number of advantages, it does have the disadvantage of providing an alternative means of accessing and tampering with the contents of the container to the later detriment of the consumer of the product.

SUMMARY OF THE INVENTION

Accordingly, in a first aspect, the present invention consists in a closure for a container, the closure comprising a top portion having an outer surface and a skirt depending from the top portion, there being an aperture through the top portion adapted to receive therethrough a tube having a first end, the outer surface being connected by a frangible connection to a cap adapted to prevent fluid communication between the first end of a tube received through the aperture and the outer surface.

In one embodiment, the cap for the tube is connected by the frangible connection to a collar that surrounds the aperture and extends upwardly from the top portion. The inner surface of the collar is preferably arranged to guide the tube through the aperture and also provide a seal to substantially prevent leaking of the contents of the container between the tube and the closure.

In a further embodiment, a further collar that surrounds the aperture can extend downwardly from the top portion to further help guide the tube through the aperture. The inner surface of the collar extending downwardly from the top portion can be frusto-conical to enhance the engagement and the sealing between the collar and the tube.

The frangible connection can comprise a plurality of frangible bridges or an area of weakness that will easily fracture on movement of the cap for the tube relative to the top portion. Fracture of the frangible connection serves to readily identify to the consumer that the tube has been previously extended from the container and that tamper of the contents of the contents may have occurred.

The cap for the tube can have a circular top portion and a skirt depending from an underside of the top portion. This circular top portion can extend outwardly beyond the radial extent of the skirt. An annular sealing rib can also extend from the underside of the top portion and seal with the outer surface, inner surface and/or the end of the tube. The skirt of the cap preferably has engagement means arranged to engage the cap with the tube. The tube is preferably a resiliently flexible material and the engagement means preferably comprises a screw thread that engages with the outer surface of the resiliently flexible tube.

The container closure can also have an annular sealing rib extending downwardly from the underside of its top portion and proximate the skirt. This annular sealing rib can also seal with either the outer surface, inner surface and/or the end of the container.

The inner surface of the skirt depending from the top portion of the container closure preferably has a screw thread complementary to a screw thread on the neck of the container.

A free edge of the skirt of the container closure is also preferably connected by a frangible connection to a tamper evident band. This frangible connection can comprise a plurality of fragile bridges or an area of weakness between the skirt and the band. The inner surface of the band preferably has a locking means which engages with a complementary locking means on the neck of the container below the screw thread thereon. On removal of the closure from the container, the locking means on the band engages with the locking means on the neck of the container such that at least partial fracture occurs to the frangible connection between the skirt and the band. In one embodiment, the locking means on the inner surface of the band can comprise inwardly extending projections that engage under the outwardly extending projections on the container neck as the closure is removed from the container.

The closure can be fabricated to seal a container for liquid. In a preferred embodiment, the closure is fabricated from materials suitable for sealing a container for oils and, in particular, various oils for motor vehicles and the like. In on embodiment, the closure is fabricated from a resilient plastics material, preferably polypropylene. The tube is preferably fabricated from poly(vinyl chloride).

In a further aspect, the present invention consists in a closure according to the present invention with a tube being positioned through the aperture and sealed by the cap.

In yet a further aspect, the present invention consists in a container having the closure described above mounted thereon.

BRIEF DESCRIPTION OF THE DRAWINGS

A preferred embodiment of the present invention will now be described with reference to the accompanying drawings, in which.

DETAILED DESCRIPTION AND PREFERRED MODE OF CARRYING OUT THE INVENTION

Figure 1:
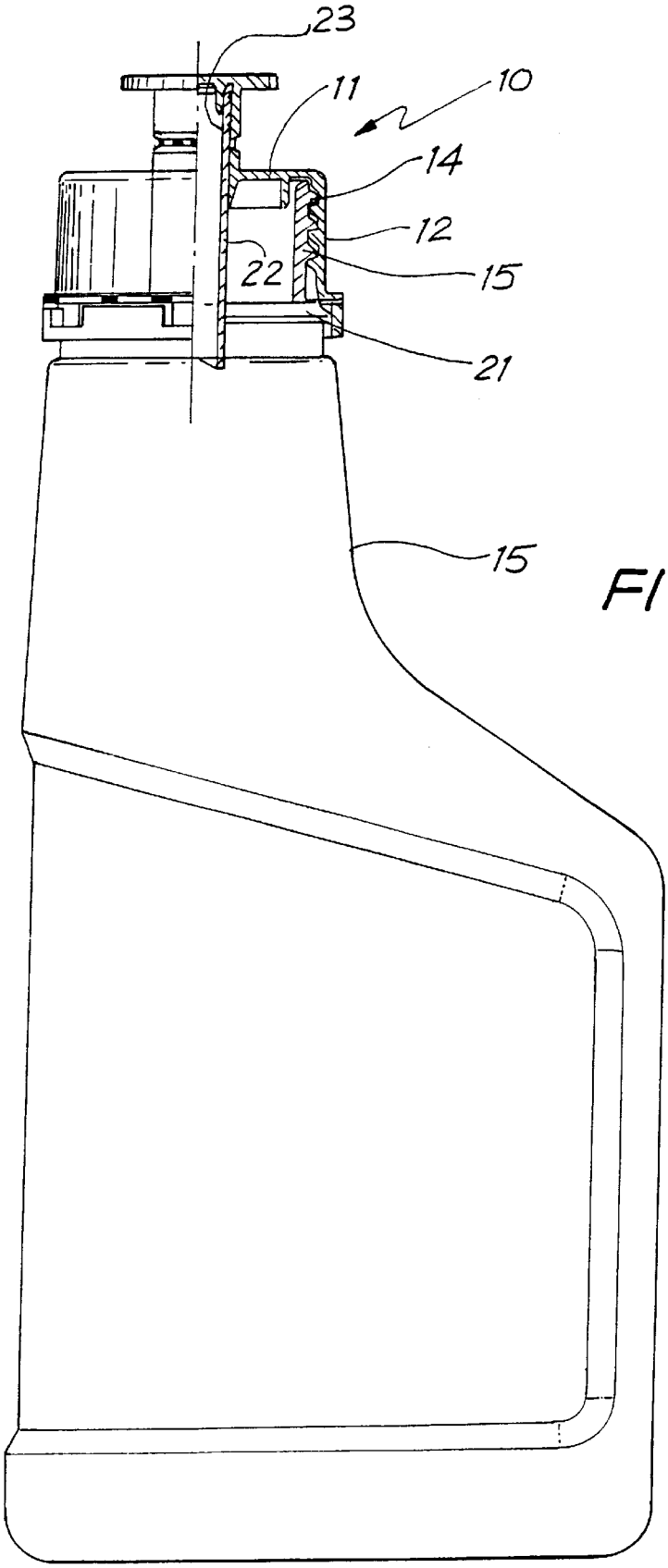
FIG. 1 is a part side elevational view, part sectional view of one embodiment of a closure according to the present invention mounted on a container.
Figure 2:
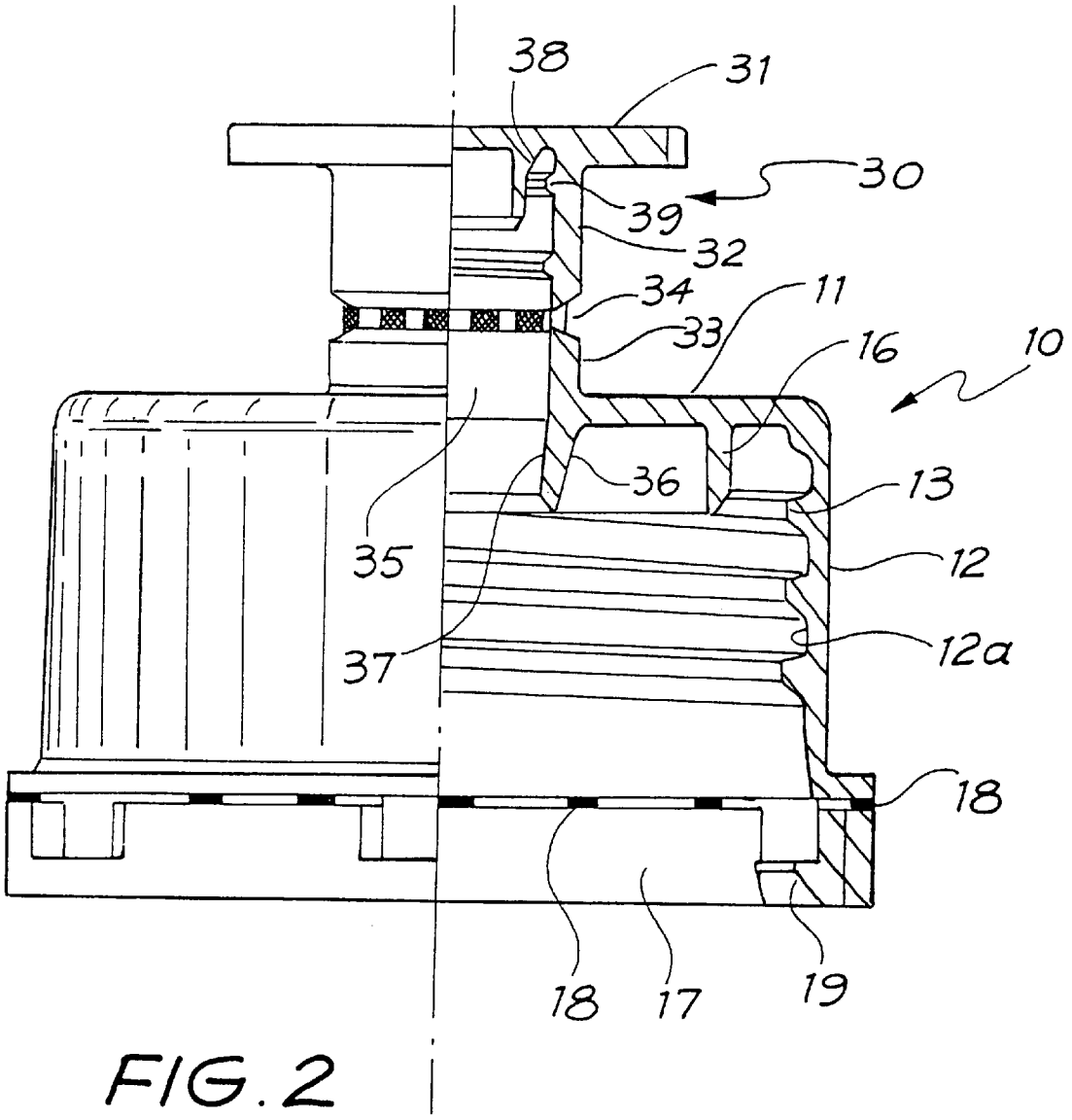
FIG. 2 is an enlarged view of the closure depicted in FIG. 1.
Figure 3:
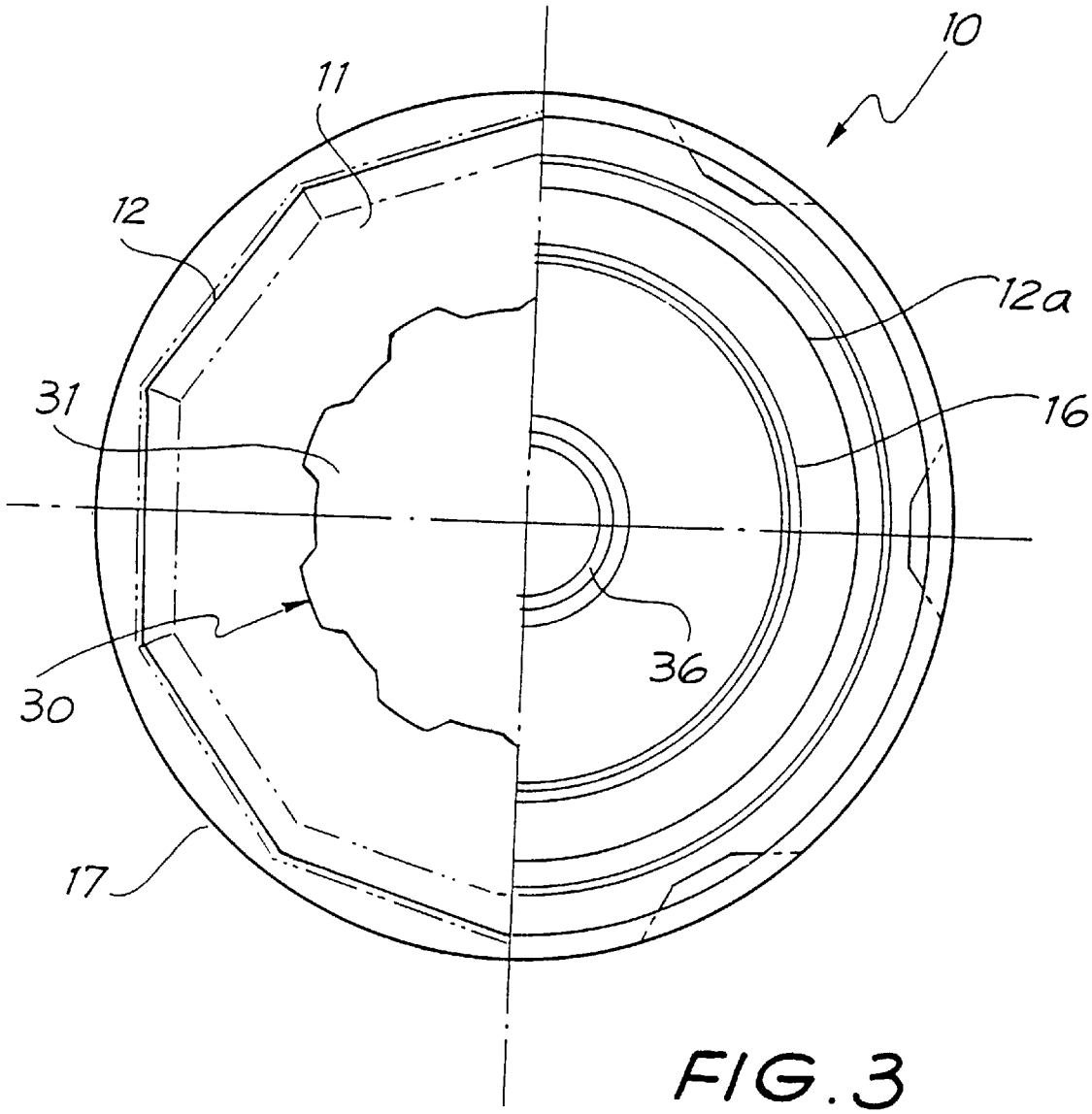
FIG. 3 is a half plan, half inverse plan view of the closure of FIG. 2.

A closure suitable for sealing a container is generally depicted as 10 in the drawings.

The closure 10 comprised a ten-sided top portion 11 and a skirt 12, having a cylindrical inner surface 12*a,* depending from the periphery thereof. On the inner surface 12*a* of the skirt 12 is a screw thread 13 which is arranged to engage with a complementary screw thread 14 on the neck of a container 15.

Depending from the underside of the top portion 11 is an annular sealing rib 16 which seals with the inner surface of the neck of the container 15 on mounting of the closure 10 to the container 15. Connected by frangible bridges 18 to the free end of the skirt 12 is a tamper evident band 17.

The band 17 has a plurality of tabs 19 extending inwardly and upwardly from the free edge of the band 17. The tabs 19 are arranged to engage under an annular bead 21 present on the neck of the container 15 upon mounting of the closure 10 to the container 15. On mounting, the tabs 19 slide up and over the bead 21 and then lock in place underneath it. On removal of the closure 10 from the container 15, the tabs 19 engage under the bead 21 thereby causing fracture of the frangible connections 18.

Located centrally in the top portion 11 is a cap generally depicted as 30. The cap 30 comprises a top portion 31 and a skirt 32 depending from an underside of the top portion 31. The free end of the skirt 32 is connected by a plurality of frangible bridges 34 to a collar 33 which is integral with the top portion 11 of the container closure 10. The collar 33 surrounds an aperture 35 in the top portion 11. The collar 33, as is depicted in the drawings, has a downwardly extending frusto-conical portion 36. The frusto-conical surface 37 serves to improve the seal formed between the collar 33 and a poly(vinyl chloride) tube 22 (in cross-section in FIG. 1) extending through the aperture 35 and so prevents the contents of the container 15 leaking around the outside of the tube 22.

The top portion 31 of the cap 30 has an annular sealing rib 38 extending downwardly therefrom and arranged to seal with the inner surface 23 of the tube 22. The inner surface of the skirt 32 also has a screw thread 39 arranged to engage with the outer surface of the tube 22 and so hold the cap 30 in place on the tube 22.

The closure 10, including the cap 30, is moulded in one piece from polypropylene which is suitable for sealing containers for vehicles oils, such an engine and transmission oil. Once moulded, the poly(vinyl chloride) tube 22 is inserted upwardly through the aperture 35 and screwed into the cap 30 such that the thread 39 engages the outer surface of the tube 22 and the sealing rib 38 seals the tube 22.

Once the tube 22 is positioned within the closure 10, the closure 10 is mounted in the usual manner on a previously filled container.

On purchase, the consumer may wish to pour a large quantity of oil from the container 15. In this case, the consumer may wish to remove the entire closure 10 from the container 15. By simply unscrewing and removing the closure 10, the contents are readily poured from the container 15. This manner of removal of the closure 10 will lead to fracture of the frangible bridges 18 and these will provide an indication that the closure 10 has been removed previously from the container 15. If, however, the consumer only wishes to dispense a small quantity of the contents with little or no mess, the option is open to use the tube 22. This is accessed by twisting the cap 30 to fracture the frangible bridges 34 and remove the cap 30 from the tube 22. The tube 22 is then drawn upwardly to extend the tube 22 partially out of the container 15. The contents are then poured from the container 15 as required by the consumer.

The tube 22 can be re-sealed by screwing the cap 30 back onto the tube 22 and pushing the tube 22 back into the container 15.

The fracture of the frangible bridges 34 serves to lessen the likelihood of previous tamper of the cap going unnoticed by the consumer.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A closure for a container, the closure comprising a top portion having an outer surface and a skirt depending from the top portion, there being an aperture through the top portion with a tube having a first end extending therethrough, a collar surrounding the aperture that is integral with and extends upwardly and downwardly from the top portion, an inner surface of the collar guiding the tube received through the aperture and providing a seal to substantially prevent leaking of the contents of the container between the tube and the closure for all possible positions of the tube in the collar relative to the closure, the collar being connected by a frangible connection to a cap that prevents fluid communication between the first end of the tube received through the aperture, and the outer surface.

2. The closure of claim 1 wherein the downwardly extending collar has a frusto-conical inner surface to enhance the engagement and the sealing between the collar and the tube.

3. The closure of claim 1 wherein the frangible connection comprises a plurality of frangible bridges or an area of weakness extending between the cap and the top portion.

4. The closure of claim 3 wherein the cap has a top portion and a skirt extending from an underside thereof, the frangible connection extending between a free end of the skirt of the cap and the top portion of the container closure.

5. The closure of claim 4 wherein the top portion of the cap extends outwardly beyond the radial extent of the skirt.

6. The closure of claim 4 wherein an annular sealing rib extends from the underside of the top portion of the cap and seals with at least the inner surface of the tube.

7. The closure of claim 4 wherein the skirt of the cap has engagement means that engage the cap with the tube.

8. The closure of claim 7 wherein the tube is a resiliently flexible material and the engagement means comprises a screw thread that engages with the outer surface of the resiliently flexible tube.

9. The closure of claim 1 wherein the container closure has an annular sealing rib extending downwardly from the underside of the top portion proximate the skirt that is sealable with at least the inner surface of the container on mounting of the closure to the container.

10. The closure of claim 1 wherein the inner surface of the skirt depending from the top portion of the container closure has a screw thread complementary to a screw thread on the neck of the container.

11. The closure of claim 1 wherein a freed edge of the skirt of the container closure is connected by a frangible connection to a tamper evident band.

12. The closure of claim 11 wherein the frangible connection between the skirt of the container closure and the band comprises a plurality of frangible bridges or an area of weakness between a free edge of the skirt of the container closure and the band.

13. The closure of claim 11 wherein the inner surface of the band has a locking means which is engageable with a complementary locking means on the neck of the container, such that on removal of the closure from the container, the locking means on the band engages with the locking means on the container and causes at least partial fracture of the frangible connection between the skirt and the band.

* * * * *